US009954271B2

(12) United States Patent
Hsieh

(10) Patent No.: US 9,954,271 B2
(45) Date of Patent: Apr. 24, 2018

(54) RADIO-FREQUENCY DEVICE AND WIRELESS COMMUNICATION DEVICE FOR ENHANCING ANTENNA ISOLATION

(71) Applicant: Wistron NeWeb Corporation, Hsinchu (TW)

(72) Inventor: Chia-Hsing Hsieh, Hsinchu (TW)

(73) Assignee: Wistron NeWeb Corporation, Hsinchu (TW)

( * ) Notice: Subject to any disclaimer, the term of this patent is extended or adjusted under 35 U.S.C. 154(b) by 243 days.

(21) Appl. No.: 14/934,116

(22) Filed: Nov. 5, 2015

(65) Prior Publication Data

US 2016/0294046 A1 Oct. 6, 2016

(30) Foreign Application Priority Data

Mar. 31, 2015 (TW) ..... 104110483 A

(51) Int. Cl.

| | |
|---|---|
| ***H01Q 1/24*** | (2006.01) |
| ***H01Q 1/52*** | (2006.01) |
| ***H01Q 9/42*** | (2006.01) |
| ***H01Q 5/378*** | (2015.01) |

(52) U.S. Cl.

CPC ..... *H01Q 1/243* (2013.01); *H01Q 1/521* (2013.01); *H01Q 5/378* (2015.01); *H01Q 9/42* (2013.01)

(58) Field of Classification Search

CPC ..... H01Q 1/243
USPC ..... 343/700
See application file for complete search history.

(56) References Cited

U.S. PATENT DOCUMENTS

| | | | | |
|---|---|---|---|---|
| 7,872,608 | B2 * | 1/2011 | Li | H01Q 1/2291 343/700 MS |
| 8,937,578 | B2 * | 1/2015 | Montgomery | H01Q 1/243 343/702 |
| 2007/0229366 | A1 * | 10/2007 | Kim | H01Q 1/243 343/700 MS |
| 2008/0252538 | A1 * | 10/2008 | Ying | H01Q 1/243 343/767 |
| 2009/0021448 | A1 * | 1/2009 | Tsai | H01Q 1/38 343/893 |
| 2012/0013519 | A1 * | 1/2012 | Hakansson | H01Q 1/243 343/835 |
| 2015/0180115 | A1 | 6/2015 | Hsieh | |

FOREIGN PATENT DOCUMENTS

| | | |
|---|---|---|
| CN | 102340049 A | 2/2012 |
| CN | 102751573 A | 10/2012 |
| CN | 202513284 U | 10/2012 |
| EP | 2 811 573 A1 | 12/2014 |

* cited by examiner

*Primary Examiner* — Dameon E Levi
*Assistant Examiner* — Walter Davis
(74) *Attorney, Agent, or Firm* — Winston Hsu

(57) ABSTRACT

A radio-frequency device includes a grounding element, a first antenna including a first parasitic element, a second antenna, a third antenna and a second parasitic element, wherein the grounding element is shared by the first, second and third antennas, the second parasitic element is electrically connected to the grounding element for guiding a first reflected signal from the first antenna to the second parasitic element, and the first parasitic element is electrically connected to the grounding element for guiding a second and third reflected signals from the second and third antennas to the first parasitic element, so as to enhance isolations of the first, second and third antennas.

18 Claims, 15 Drawing Sheets

RADIO-FREQUENCY DEVICE AND WIRELESS COMMUNICATION DEVICE FOR ENHANCING ANTENNA ISOLATION

BACKGROUND OF THE INVENTION

1. Field of the Invention

The present invention relates to a radio-frequency device and wireless communication device, and more particularly, to a radio-frequency device and wireless communication device capable of enhancing antenna isolation so as to dispose multiple antennas in a limited space while maintaining preferable antenna efficiency and bandwidth.

2. Description of the Prior Art

Electronic products with wireless communication functionalities, such as laptops, tablet PCs, personal digital assistants (PDAs), mobile phones, wireless base stations, smart meters, and USB dongles, utilize antennas to send and receive wireless signals so as to access wireless networks. In order to let the users access wireless communication networks more conveniently, the antenna bandwidth should be as broad as possible so that more communication protocols can be complied with, while the antenna size should be minimized to meet a demand for smaller and lighter products. In addition, with evolution of wireless communication technologies a wireless communication device may be required to equip more antennas. For example, a modern USB dongle may be equipped with multiple sets of antennas to establish a plurality of antenna channels for spatial diversity and provide multiple antenna patterns, which allows the user to execute different applications using different wireless communication systems (e.g. Bluetooth and Wi-Fi) on the same frequency band at the same time. Furthermore, the spectrum efficiency and the transmission speed may be enhanced with multiple sets of antennas, thereby improving the communication quality. Since multiple sets of antennas are disposed in a communication device, the interference problems have become one of the important design considerations for antenna designs.

In general, multiple sets of antennas are respectively disposed on the diagonal positions or are kept in the farthest distance between one another on the longest edge of a wireless communication device so as to minimize the interference between antennas and achieve better complementary antenna characteristics. However, if the overall size of the wireless communication device or the available space for disposing the antennas is very small, careful considerations must be taken when drawing the layout of the antennas.

In addition, the broadband requirement has become a primary item for antenna designs as the evolution of wireless communication technologies. The common broadband antennas, such as planar inverted-F antennas, can meet the requirement of multi-frequency operation; however, the radiation elements of such antennas are too long to be installed in a miniature wireless communication system. Furthermore, the low frequency band of these kinds of antennas is too narrow (only about 110 MHz) so that they cannot meet the broadband requirement of the wireless communication systems.

Therefore, how to design multiple sets of antennas in a limited space which meets all of the antenna requirements for transmission, bandwidth, efficiency, and isolation is an important topic to be addressed and discussed.

SUMMARY OF THE INVENTION

An objective of the present invention is to provide a radio-frequency device and wireless communication device capable of enhancing antenna isolation so as to dispose multiple sets of antennas in a limited space while maintaining preferable antenna efficiency and bandwidth.

An embodiment of the present invention discloses a radio-frequency device for a wireless communication device. The radio-frequency device includes an antenna disposition area, a grounding element, a first antenna, a second antenna, a third antenna and a second parasitic element. The first antenna is disposed in the antenna disposition area for transmitting or receiving a first radio signal, wherein the first antenna includes a metal coupling piece; a first radiating element, electrically connected to the grounding element for emitting the first radio signal; a first signal feed-in element, electrically connected to the metal coupling piece for coupling the first radio signal to the first radiating element via the metal coupling piece such that the first radio signal is emitted via the first radiating element; and a first parasitic element, electrically connected to the grounding element. The second antenna is disposed in the antenna disposition area for transmitting or receiving a second radio signal. The third antenna is disposed in the antenna disposition area for transmitting or receiving a third radio signal. The second parasitic element is disposed in the antenna disposition area and is electrically connected to the grounding element for guiding a first reflected signal generated from the first radio signal to the second parasitic element so as to enhance isolations of the first antenna, the second antenna and the third antenna. The grounding element between the first antenna, the second parasitic element, the second antenna and the third antenna is shared by the first antenna, the second antenna and the third antenna. The metal coupling piece is disposed between the first parasitic element and the first radiating element. The first parasitic element is used for guiding a second reflected signal generated from the second radio signal and a third reflected signal generated from the third radio signal to the first parasitic element so as to enhance isolations of the first antenna, the second antenna and the third antenna.

Another embodiment of the present invention discloses a wireless communication system including a system grounding element, for providing ground; a radio signal processing unit, for processing a plurality of radio signals; and a radio-frequency device. The radio-frequency device includes an antenna disposition area, a grounding element, a first antenna, a second antenna, a third antenna and a second parasitic element. The first antenna is disposed in the antenna disposition area for transmitting or receiving a first radio signal of the plurality of radio signals, wherein the first antenna includes a metal coupling piece; a first radiating element, electrically connected to the grounding element for emitting the first radio signal; a first signal feed-in element, electrically connected to the metal coupling piece for transmitting the first radio signal to the first radiating element via the metal coupling piece such that the first radio signal is emitted via the first radiating element; and a first parasitic element, electrically connected to the grounding element. The second antenna is disposed in the antenna disposition area for transmitting or receiving a second radio signal of the plurality of radio signals. The third antenna is disposed in the antenna disposition area for transmitting or receiving a third radio signal of the plurality of radio signals. The second parasitic element is disposed in the antenna disposition area and is electrically connected to the grounding element for guiding a first reflected signal generated from the first radio signal to the second parasitic element so as to enhance isolations of the first antenna, the second antenna and the third antenna. The grounding element between the first antenna, the second parasitic element, the second antenna and the third antenna is shared by the first antenna, the second antenna and the third antenna. The metal coupling piece is disposed between the first parasitic element and the first radiating element. The first parasitic element is used for guiding a second reflected signal generated from the second radio signal and a third reflected signal generated from the third radio signal to the first parasitic element so as to enhance isolations of the first antenna, the second antenna and the third antenna.

These and other objectives of the present invention will no doubt become obvious to those of ordinary skill in the art after reading the following detailed description of the preferred embodiment that is illustrated in the various figures and drawings.

DETAILED DESCRIPTION

Figure 1:
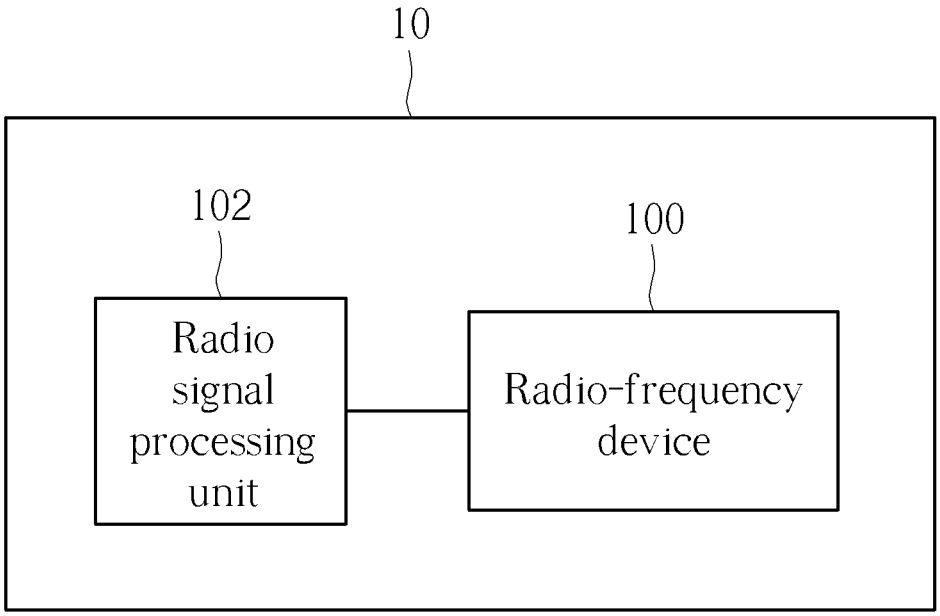
FIG. 1 is a schematic diagram of a wireless communication device according to an embodiment of the present invention.

Please refer to FIG. 1, which is a schematic diagram of a wireless communication device 10 according to an embodiment of the present invention. The wireless communication device 10 may be any electronic product with wireless communication functionalities such as a mobile phone, a computer system, a wireless access point device, a wireless base station, a USB dongle, and so on. The wireless communication device 10 is briefly composed of a radio-frequency device 100 and a radio signal processing unit 102, but is not limited herein. The radio-frequency device 100 provides a wireless communication functionality of the wireless communication device 10. Specifically, the radio signal processing unit 102 may support an operation of simultaneous transmission or reception of wireless signals in the same frequency band, and the radio-frequency device 100 ensures isolation under this operation. Examples of "simultaneous transmission or reception of wireless signals in the same frequency band" include simultaneously transmitting or receiving wireless signals by a wireless communication system supporting the multiple input multiple output (MIMO) communication protocol, or simultaneously transmitting or receiving wireless signals by different wireless communication systems (e.g., Bluetooth and Wi-Fi) operating in the same frequency band.

Figure 2:
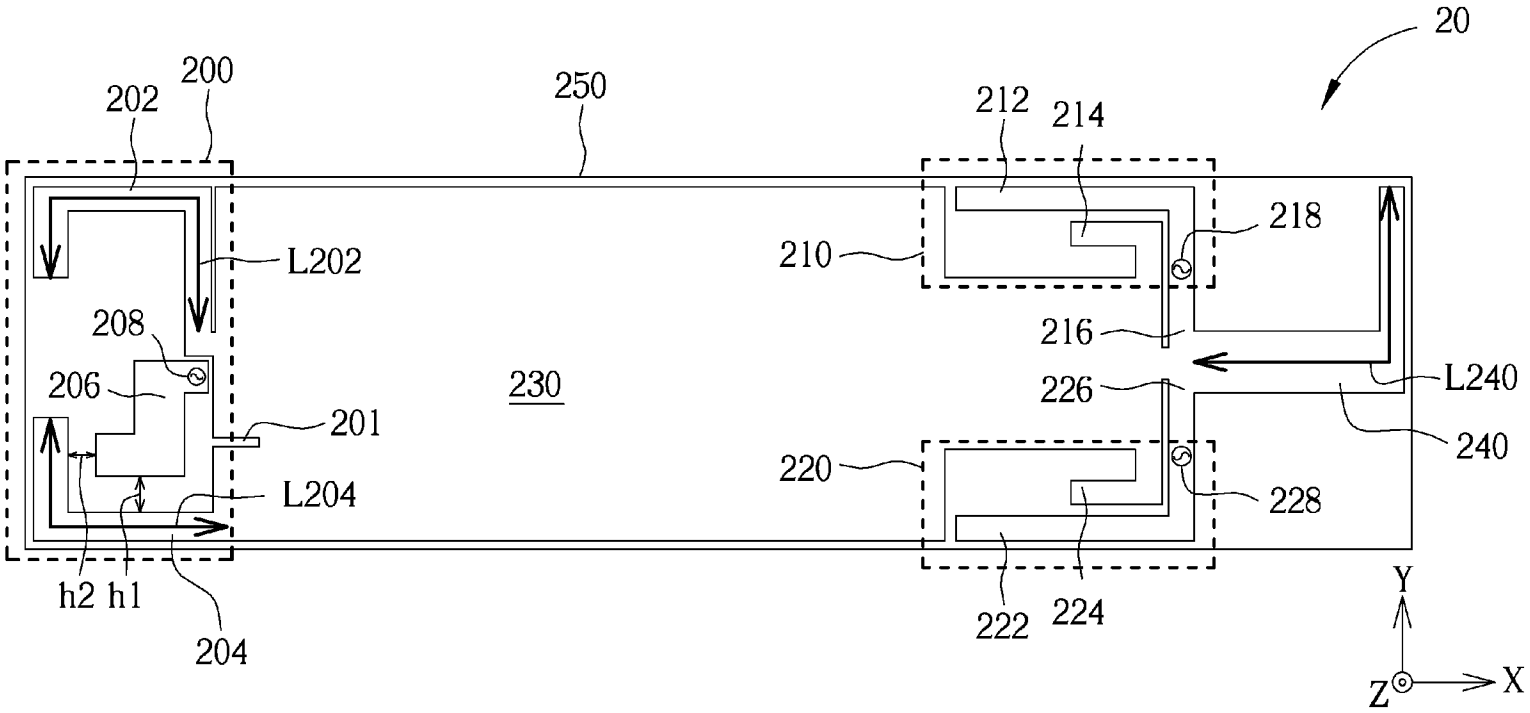
FIG. 2 is a schematic diagram of a radio-frequency device according to an embodiment of the present invention.

Please refer to FIG. 2, which is a schematic diagram of a radio-frequency device 20 according to an embodiment of the present invention. The radio-frequency device 20 may be applied to the radio-frequency device 100 shown in FIG. 1. The radio-frequency device 20 includes a first antenna 200, a second antenna 210, a third antenna 220, a grounding element 230, a second parasitic element 240 and an antenna disposition area 250. The first antenna 200, the second antenna 210, and the third antenna 220 are disposed in the antenna disposition area 250 for simultaneously transmitting or receiving a first radio signal, a second radio signal and a third radio signal of the same frequency band, respectively. For example, the first antenna 200 may be used for transmitting or receiving the first radio signal of a Bluetooth communication system, and the second antenna 210 and the third antenna 220 may be used for transmitting or receiving the second radio signal and the third radio signal of a Wi-Fi communication system. The first antenna 200, the second antenna 210, and the third antenna 220 are disposed on a same substrate. The three antennas share the grounding element 230 to connect to a system ground of the wireless communication device 10. The radio signal processing unit 102 (not shown in FIG. 2) may be disposed in a center of the antenna disposition area 250. The first antenna 200 is disposed at one side of the antenna disposition area 250 and the second antenna 210, the third antenna 220 and the second parasitic element 240 are disposed at the other side of the antenna disposition area 250.

The first antenna 200 includes a first parasitic element 202, a first radiating element 204, a metal coupling piece 206 and a signal feed-in element 208. The signal feed-in element 208 is electrically connected to the metal coupling piece 206 for coupling the first radio signal to the first radiating element 204 via the metal coupling piece 206. The first radiating element 204 is disposed at one side of the metal coupling piece 206, electrically connected to the grounding element 230, and coupled to the metal coupling piece 206. In other words, signals on the first radiating element 204 and the metal coupling piece 206 are connected via a coupling effect so that the first radiating element 204 may transmit the first radio signal from the metal coupling piece 206. The first parasitic element 202 is disposed at the other side of the metal coupling piece 206 opposite to the first radiating element 204. The first parasitic element 202 is electrically connected to the grounding element 230 for guiding a second reflected signal generated from the second radio signal of the second antenna 210 and a third reflected signal generated from the third radio signal of the third antenna 220 to the first parasitic element 202, which prevents the first radiating element 204 of the first antenna 200 from interfering by the second reflected signal and the third reflected signal. As such, isolations between the first antenna 200, the second antenna 210 and the third antenna 220 may be enhanced. Thus, antenna efficiencies may be improved. A length L204 of the first radiating element 204 and a length L202 of the first parasitic element 202 may be substantially equal to a quarter-wavelength corresponding to the frequency band of the first antenna 100. However, the lengths L204 and L202 may not be exactly the same.

The grounding element 230 is formed with a slot 201. The slot 201 is disposed between the signal feed-in element 208 and the first radiating element 204 such that a low-frequency current generated from the first antenna 200 flows to the first radiating element 204 from the signal feed-in element 208 around the slot 201. A signal path of the low-frequency current generated from the first antenna 200 may be adjusted by adjusting a length and an area of the slot 201, thereby an operating frequency of the first antenna 200 may be modified as the length and the area of the slot 201 changes. In another embodiment of the present invention, the slot 201 may be omitted if the length of the current path generated from the first antenna 200 has already met practical requirements.

The second antenna 210 includes a second radiating element 212, a third radiating element 214, a short-circuit unit 216, and a signal feed-in element 218. The third radiating element 214 is electrically connected to the grounding element 230. The signal feed-in element 218 is electrically connected to the second radiating element 212 for transmitting the second radio signal to the second radiating element 212 such that the second radio signal is emitted via the second radiating element 212. The short-circuit unit 216 is electrically connected between the second radiating element 212, the grounding element 230 and the second parasitic element 240.

The third antenna 220 includes a fourth radiating element 222, a fifth radiating element 224, a short-circuit unit 226 and a signal feed-in element 228. The fifth radiating element 224 is electrically connected to the grounding element 230. The signal feed-in element 228 is electrically connected to the fourth radiating element 222 for transmitting the third radio signal to the fourth radiating element 222 such that the third radio signal may be emitted via the fourth radiating element 222. The short-circuit unit 226 is electrically connected between the fourth radiating element 222, the grounding element 230 and the second parasitic element 240.

The second antenna 210 and the third antenna 220 resemble a planar inverted-F antenna (PIFA) with a short-circuit unit which connects the radiating element to a ground (i.e., the short-circuit unit 216 or 226). The second antenna 210 and the third antenna 220 may be other types of antennas, which is not limited to the PIFA type. Note that the second radiating element 212 and the fourth radiating element 222 may be used to excite lower frequency resonant modes, while the third radiating element 214 and the fifth radiating element 224 may be used to excite higher frequency resonant modes.

The second parasitic element 240 is disposed in the antenna disposition area 250, electrically connected to the grounding element 230, for guiding reflected signals generated from the first radio signal of the first antenna 200 to the second parasitic element 240, which prevents the second radiating element 212 of the second antenna 210 and the fourth radiating element 222 of the third antenna 220 from interfering by the reflected signals. As such, isolations between the first antenna 200, the second antenna 210 and the third antenna 220 may be enhanced. A length L240 of the second parasitic element 240 may be substantially equal to a quarter-wavelength corresponding to the frequency band of the first radio signal of the first antenna 200.

The first parasitic element 202 and the second parasitic element 240 may respectively guide reflected signals generated from the first radio signal, the second radio signal and the third radio signal, which prevents the main radiating element (i.e. the first radiating element 204, the third radiating element 212 and the fifth radiating element 224) of the first antenna 200, the second antenna 210 and the third antenna 220 from interfering by each other. As such, isolations between the first antenna 200, the second antenna 210 and the third antenna 220 may be enhanced.

Figure 3A:
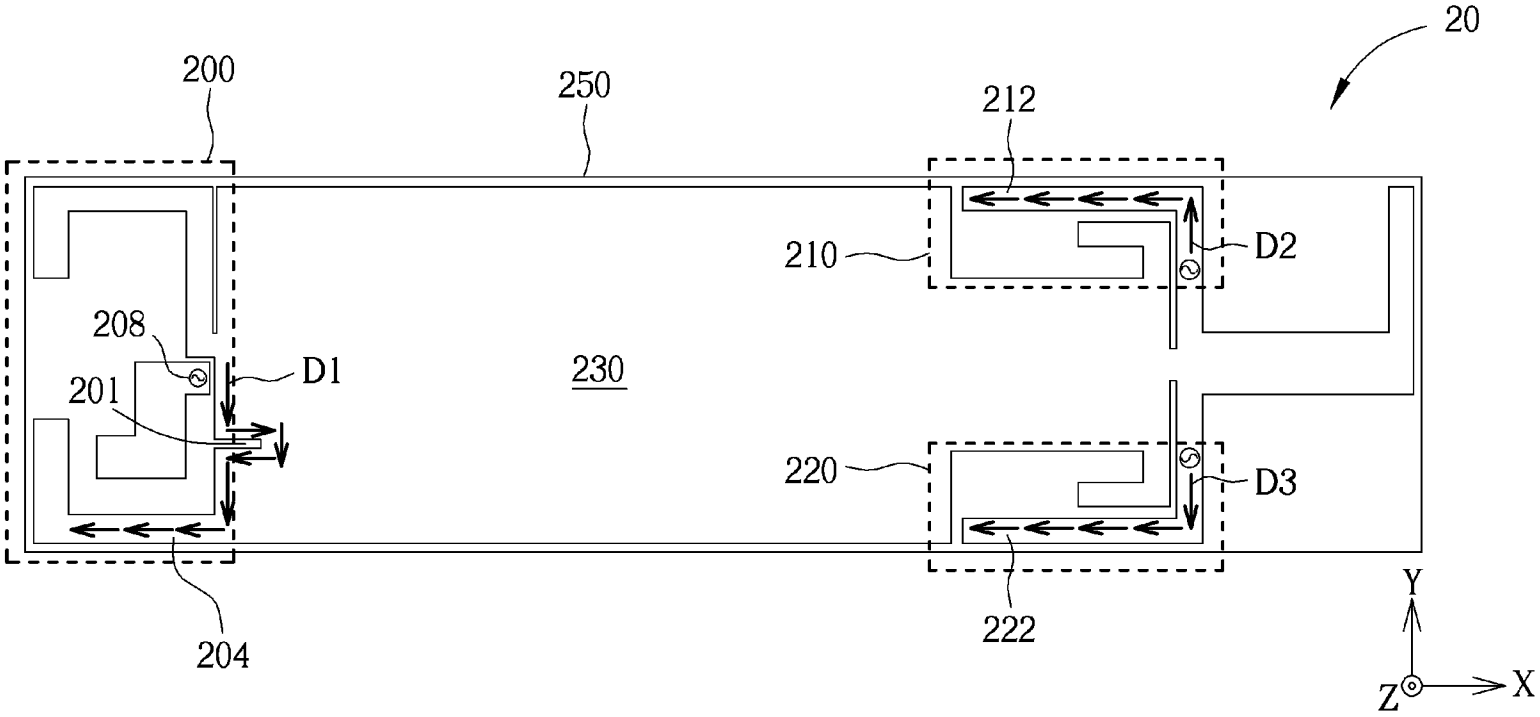
FIG. 3A shows a current distribution diagram of low-frequency signals for the radio-frequency device shown in FIG. 2.
Figure 3B:
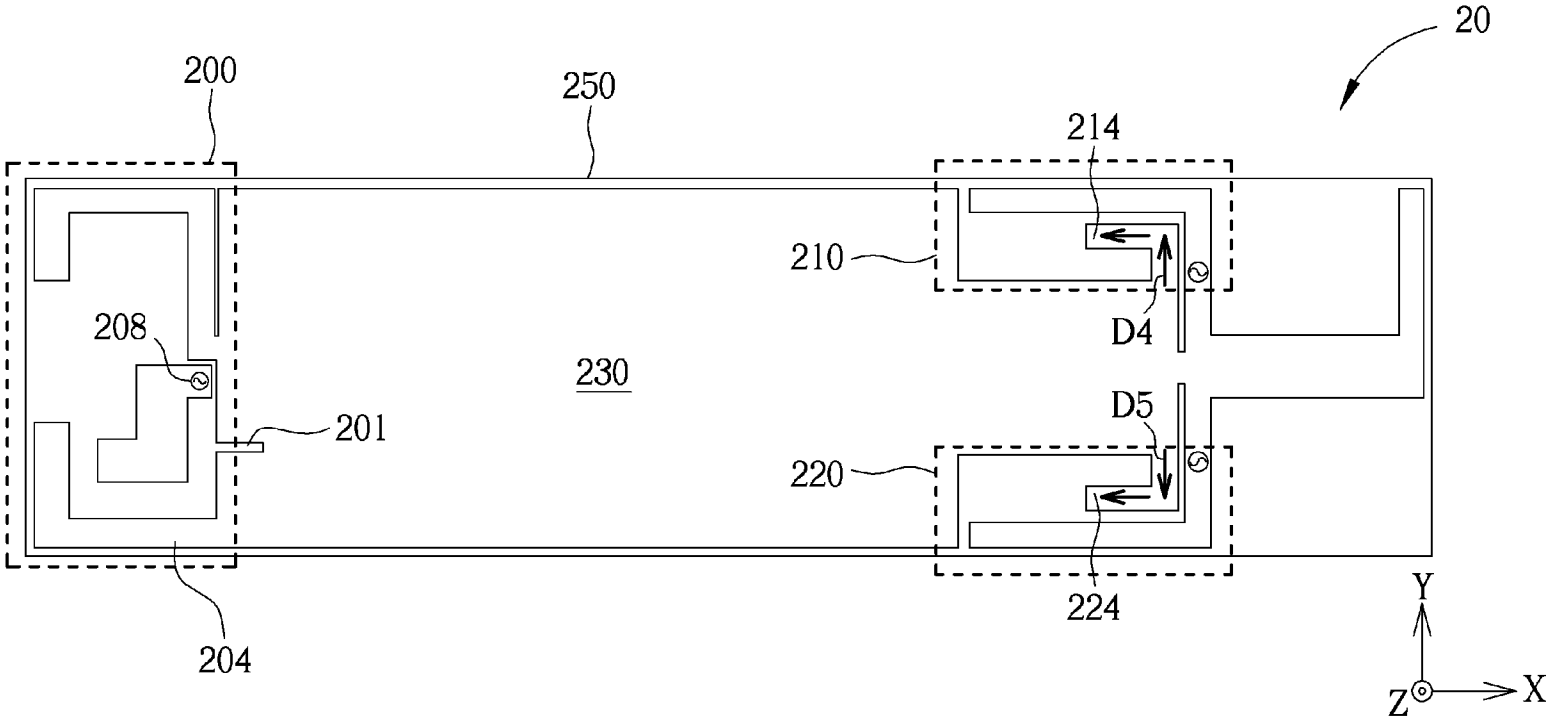
FIG. 3B shows a current distribution diagram of high-frequency signals for the radio-frequency device shown in FIG. 2.

Please refer to FIG. 3A and FIG. 3B, which respectively illustrates the current distribution of low-frequency signals and high-frequency signals of the radio-frequency device when all of the first antenna 200, the second antenna 210, and the third antenna 220 are transmitting or receiving signals at the same time. As shown in FIG. 3A, a current path from the signal feed-in element 208 to the first radiating element 204 around the slot 201 may be a shortest path for a low-frequency current path D1 of the first antenna 200 flowing from the signal feed-in element 208 to an open end of the first radiating element 204. A current path from where the grounding element 230 is connected to the first radiating element 204 to the open end of the first radiating element 204 may be a shortest path for the reflected signals from the second antenna 210 and the third antenna 220 flowing to the open end of the first radiating element 204. Thus, the current path D1 observed by the first antenna 200 may be different from the current paths observed by the second antenna 210 and the third antenna 220 on the same first radiating element 204. As such, isolations between the first antenna 200, the second antenna 210 and the third antenna 220 may be enhanced.

In addition, since the second antenna 210 and the third antenna 220 are disposed opposite to each other, a direction of the current path D2 induced by the second radio signal on the second antenna 210 (e.g. the current on the second radiating element 212) is opposite to a direction of the current path D3 induced by the third radio signal on the third antenna 220 (e.g. the current on the fourth radiating element 222). Thus, good isolations between the second antenna 210 and the third antenna 220 may be achieved.

Similarly, as shown in FIG. 3B, since the second antenna 210 and the third antenna 220 are disposed opposite to each other, a direction of the current path D4 induced by the second radio signal on the second antenna 210 (e.g. the current on the third radiating element 214) is opposite to a direction of the current path D5 induced by the third radio signal on the third antenna 220 (e.g. the current on the fifth radiating element 224). Thus, good isolations between the second antenna 210 and the third antenna 220 may be achieved.

Figure 4A:
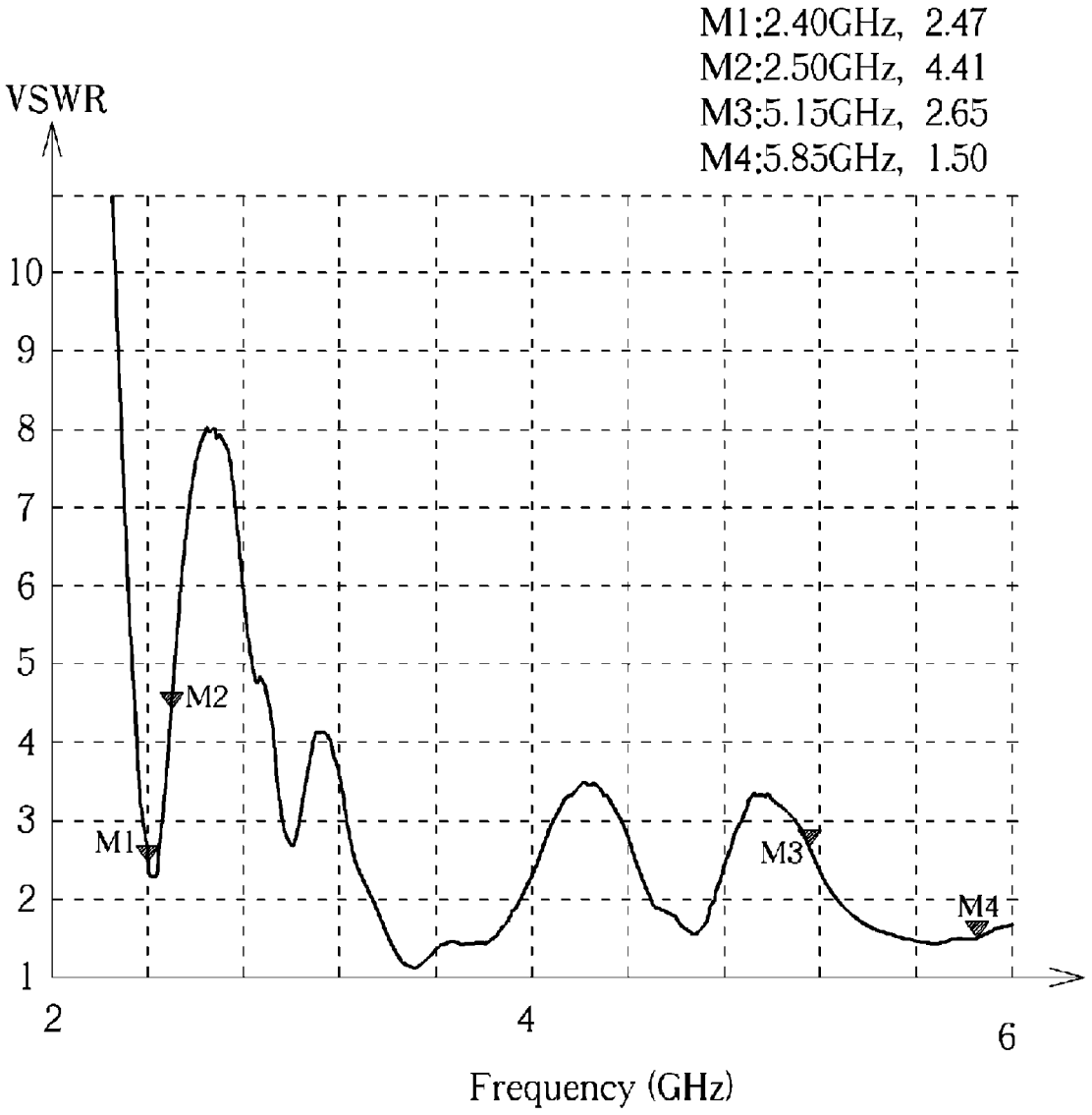
FIG. 4A to FIG. 4C are voltage-standing wave ratio diagrams of the radio-frequency device shown in FIG. 2.
Figure 4B:
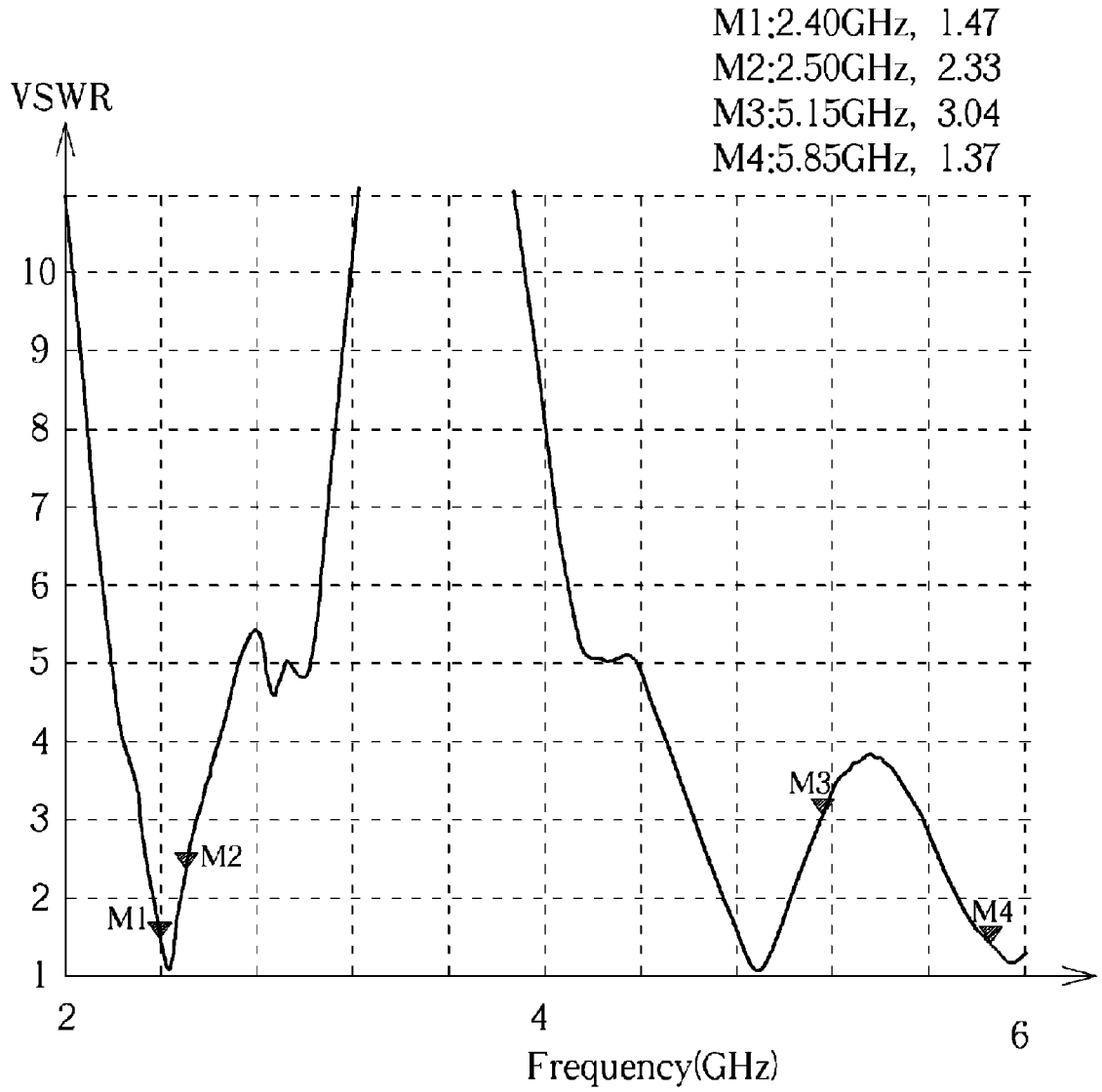
Figure 4C:
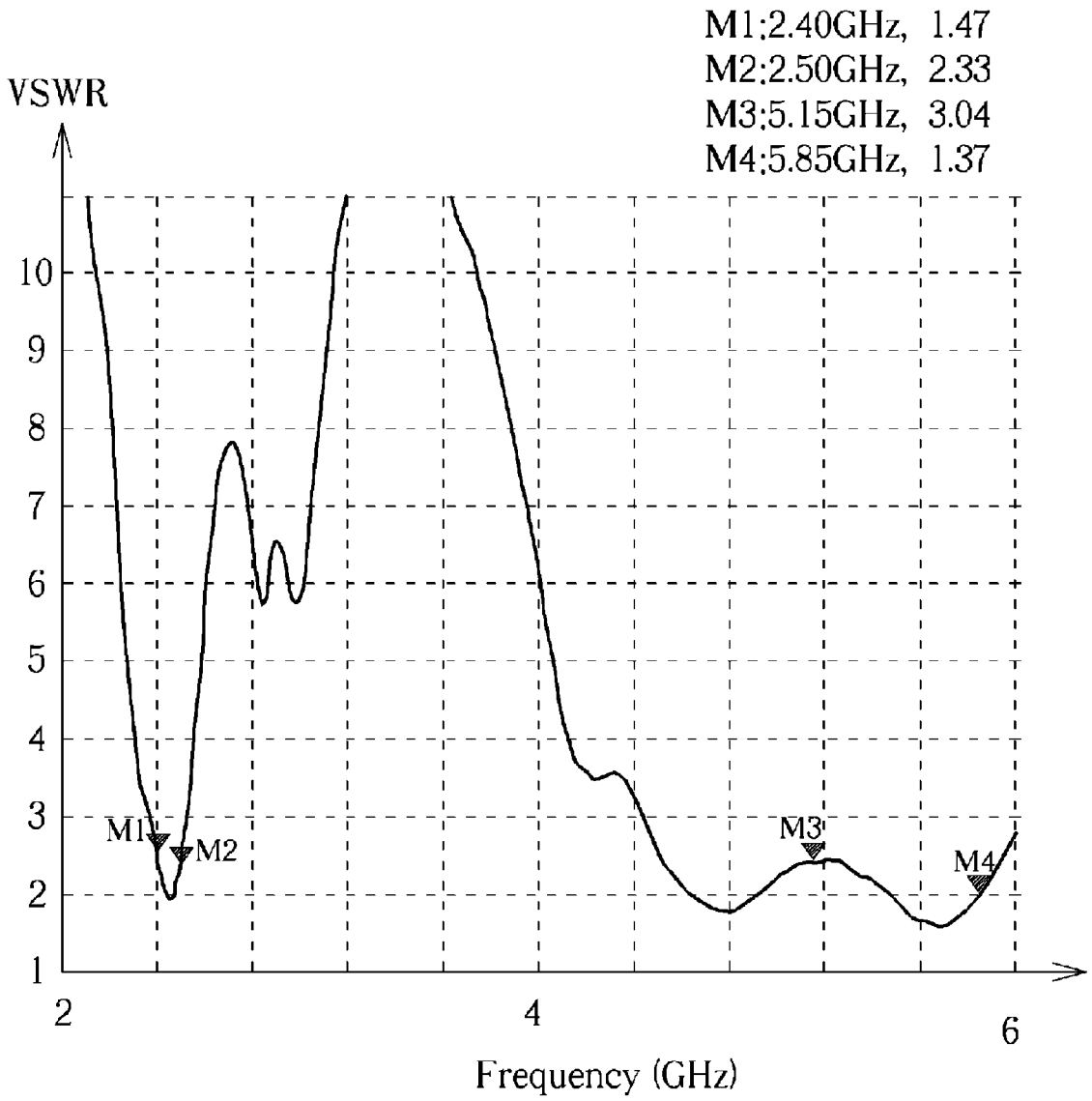
Figure 5A:
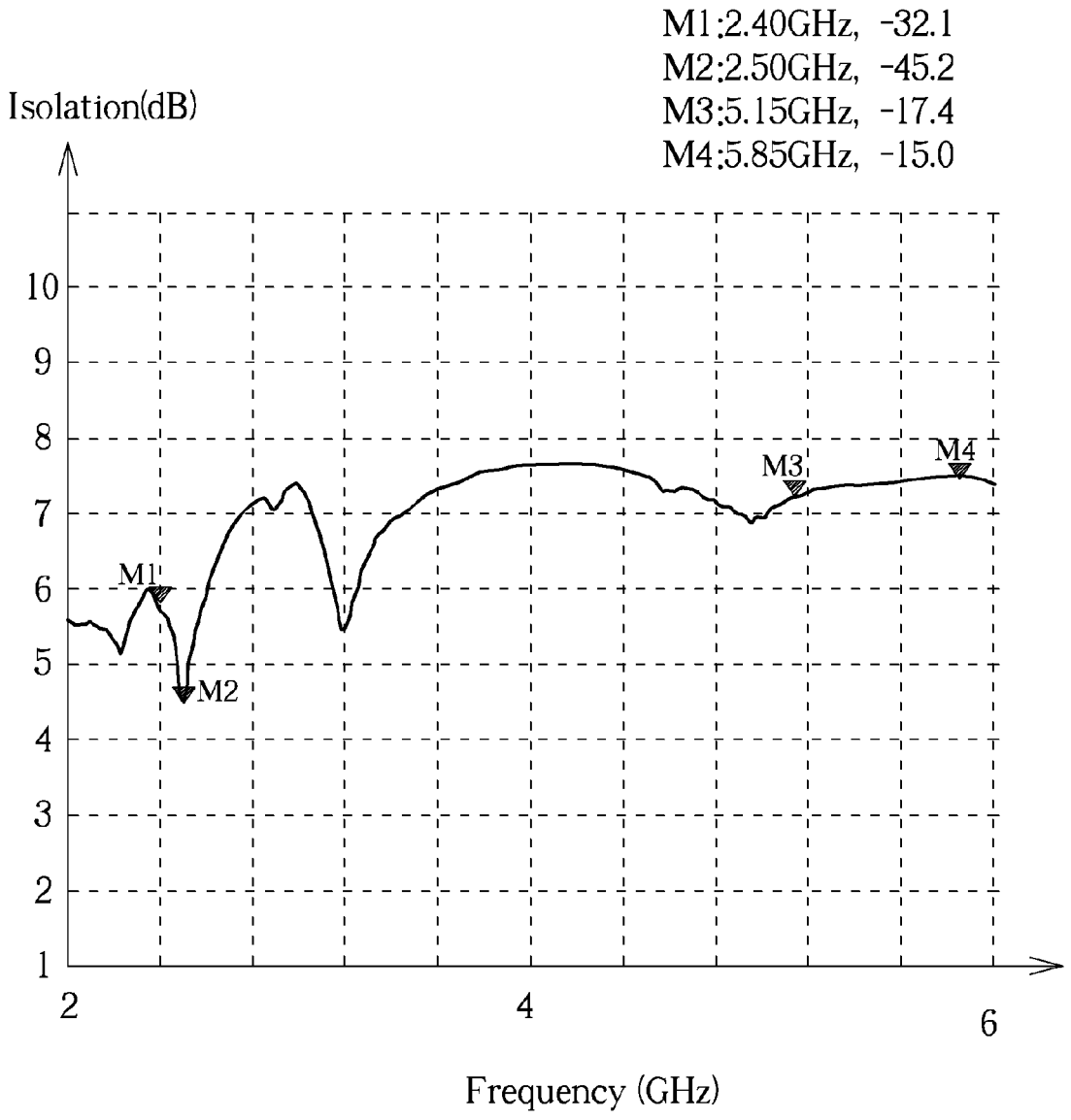
FIG. 5A and FIG. 5B are antenna isolation diagrams of the radio-frequency device shown in FIG. 2.
Figure 5B:
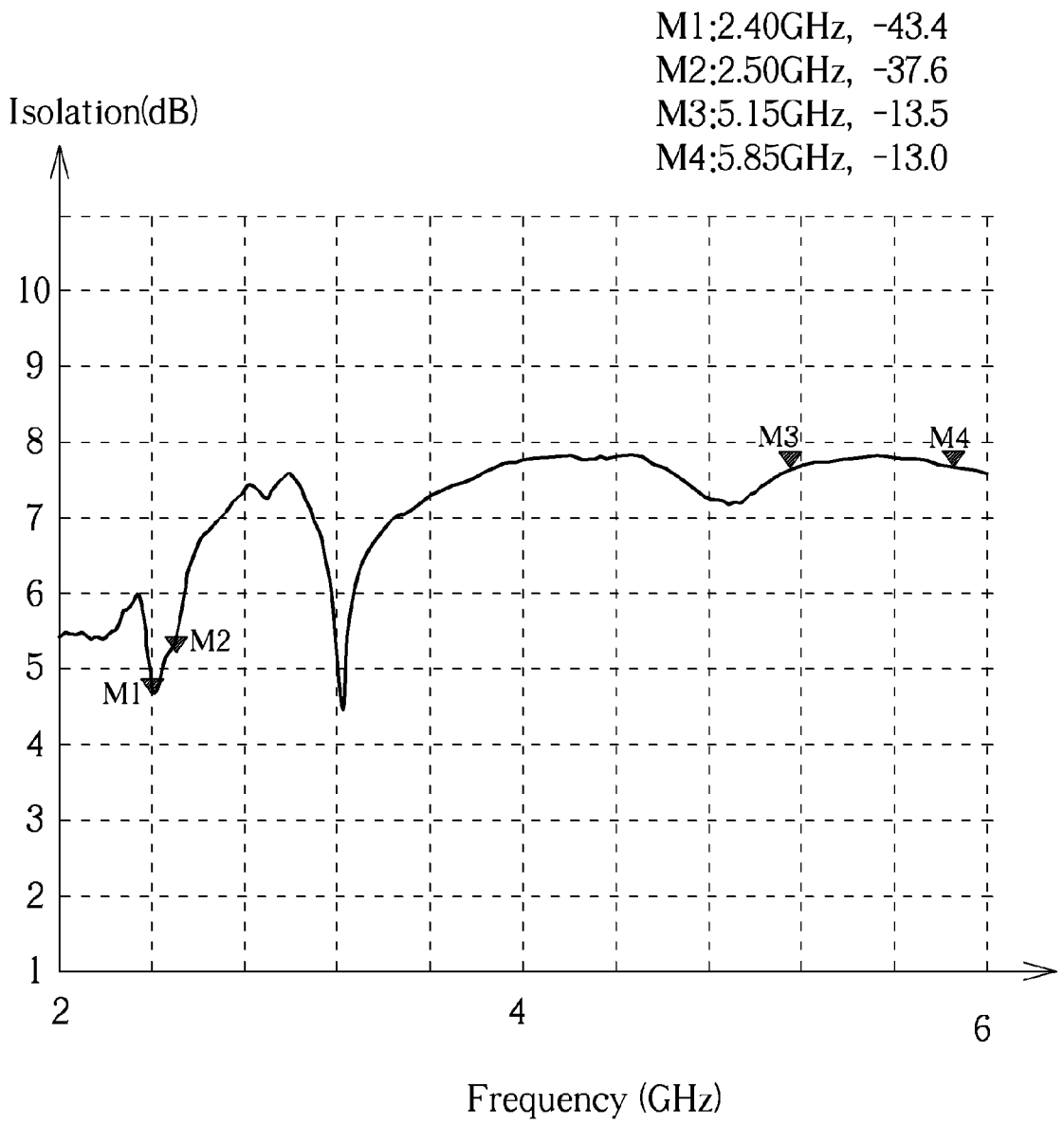

Furthermore, FIG. 4A shows a voltage-standing wave ratio (VSWR) diagram of the first antenna 200, FIG. 4B shows a VSWR diagram of the second antenna 210, and FIG. 4C shows a VSWR diagram of the third antenna 220. FIG. 5A shows the antenna isolation between the first antenna 200 and the second antenna 210, and FIG. 5B shows the antenna isolation between the first antenna 200 and the third antenna 220. As shown in FIG. 4A to FIG. 5B, these figures prove that all of the first antenna 200, the second antenna 210, and the third antenna 220 have broadband characteristics, and the isolations between each two antennas are lower than −30 dB in the range of 2.4 GHz to 2.5 GHz.

Note that in embodiments of the present invention, the reflected current from the first antenna 200 is guided to the second parasitic element 240 to prevent the second radiating element 212 of the second antenna 210 and the fourth radiating element 222 of the third antenna 220 from interfering by the reflected current from the first antenna 200.

Meanwhile, the reflected currents from the second antenna 210 and the third antenna 220 is guided to the first parasitic element 202 of first antenna 200 to prevent the first radiating element 204 from interfering by the reflected currents from the second antenna 210 and the third antenna 220. The slot 201 may be utilized to modify the current path D1 of the first antenna 200 to ensure that the antennas may have preferable bandwidth, efficiency, and isolations. Those skilled in the art may make alterations and/or modifications according to the abovementioned embodiments, which is not limited.

For instance, radio signals generated from the first antenna 200 may be fed into the first radiating element 204 via the metal coupling piece 206 by coupling, where coupling gaps h1, h2 may be adjusted appropriately. Unlimitedly, radio signals may be fed to the first radiating element 204 by various feeding schemes. In addition, shapes of the first parasitic element 202, the first radiating element 204, the metal coupling piece 206, the second radiating element 212, the third radiating element 214, the fourth radiating element 222, and the fifth radiating element 224 may be stretched or changed along X-axis, Y-axis, or Z-axis, which is not limited to the embodiment shown in FIG. 1. The short-circuit units 216 and 226 may be used to connect the radiating elements 212 and 222 with the grounding element 230 for impedance matching. Shapes or forms of the short-circuit units 216 and 226 may be modified appropriately based on the entire antenna matching and bandwidth requirements. Moreover, the radio-frequency device 20 may be set on a substrate, which may be a printed circuit board (PCB) or any kinds of substrate.

Figure 6:
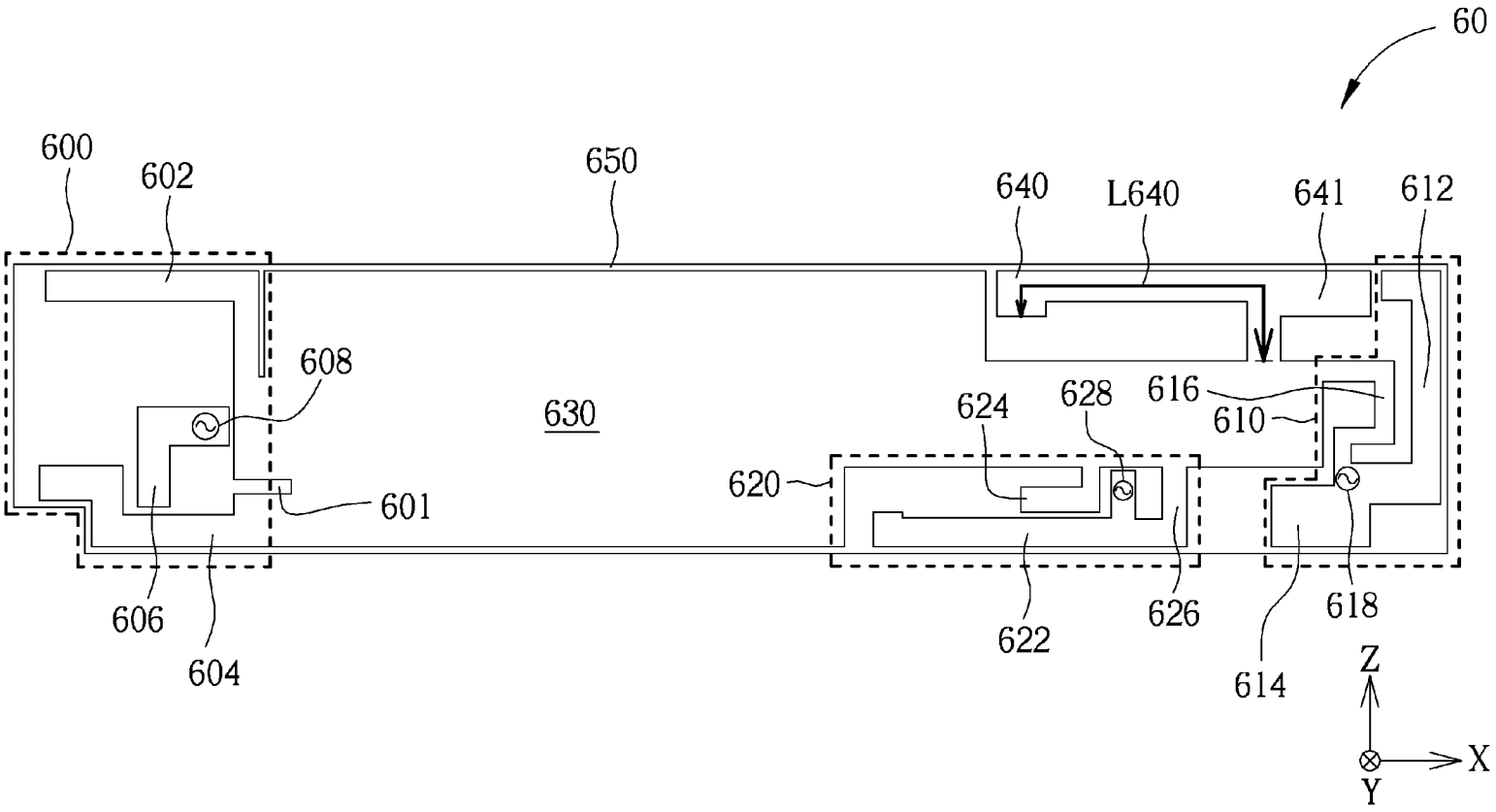
FIG. 6 is a schematic diagram of a radio-frequency device according to an embodiment of the present invention.

Please refer to FIG. 6, which is a schematic diagram of a radio-frequency device 60 according to another embodiment of the present invention. Orientations of the radio-frequency devices 20 and 60 are different. The radio-frequency device 20 is disposed on the X-Y plane, while the radio-frequency device 60 is disposed on the X-Z plane. A first antenna 600, a second antenna 610, a third antenna 620 and a second parasitic element 640 is disposed on an antenna disposition area 650 of the radio-frequency device 60. The first antenna 600 includes a first parasitic element 602, a first radiating element 604, a metal coupling piece 606, and a signal feed-in element 608. The second antenna 610 includes a second radiating element 612, a third radiating element 614, a short-circuit unit 616 and a signal feed-in element 618. The third antenna 620 includes a fourth radiating element 622, a fifth radiating element 624, a short-circuit unit 626 and a signal feed-in element 628.

The first antenna 600 is similar to the first antenna 200, differences between the first antenna 600 and the first antenna 200 lie in shapes and widths of the first parasitic element 602 and the first radiating element 604. The first parasitic element 602 may guide the reflected currents from the second antenna 610 and the third antenna 620 flowing to the first parasitic element 602 of first antenna 200, which prevents the first radiating element 604 from interfering with the reflected currents from the second antenna 610 and the third antenna 620, and thus the antennas may have preferable bandwidth, efficiency, and isolations. The grounding element 630 is formed with a slot 601. The slot 601 is disposed between the signal feed-in element 608 and the first radiating element 604 such that a low-frequency current generated from the first antenna 600 flows to the first radiating element 604 from the signal feed-in element 608 around the slot 601. In another embodiment of the present invention, the slot 601 may be omitted if a length of the current path generated from the first antenna 600 has already met practical requirements.

The second antenna 210 and the third antenna 220 is disposed opposite to or symmetric to each other, while the second antenna 610 and the third antenna 620 is disposed perpendicular to each other to adapt to environmental differences for the wireless communication device. A difference between the second antennas 210 and 610 is that the second radiating element 612 of the second antenna 610 surrounds the short-circuit unit 616. A difference between the third antennas 220 and 620 is that a short-circuit unit 626 of the third antenna 620 is electrically connected between the fourth radiating element 622 and the grounding element 630. The second radiating element 612 substantially extends along the Z-axis, the fourth radiating element 622 substantially extends along the X-axis, and the second radiating element 612 and the fourth radiating element 622 are perpendicular to each other. The third radiating element 614 and the fifth radiating element 624 are substantially extended along the X-axis, and the third radiating element 614 and the fifth radiating element 624 are parallel to each other.

The second parasitic element 640 is electrically connected to the grounding element 630, disposed between the second antenna 610 and the third antenna 620, for guiding reflected signals generated from the first antenna 600 to the second parasitic element 640, which prevents the second radiating element 612 and the fourth radiating element 622 from interfering by the reflected signals from the first antenna 600, and thus the antennas may have preferable bandwidth, efficiency, and isolations. A length L640 of the second parasitic element 640 is substantially equal to a quarter-wavelength corresponding to the frequency band of the first antenna 600. The second parasitic element 640 includes a branch 641 disposed at an end of the second radiating element 612 for coupling to the second radiating element 612 to make signal connections between the second radiating element 612 and the second parasitic element 640.

Figure 7A:
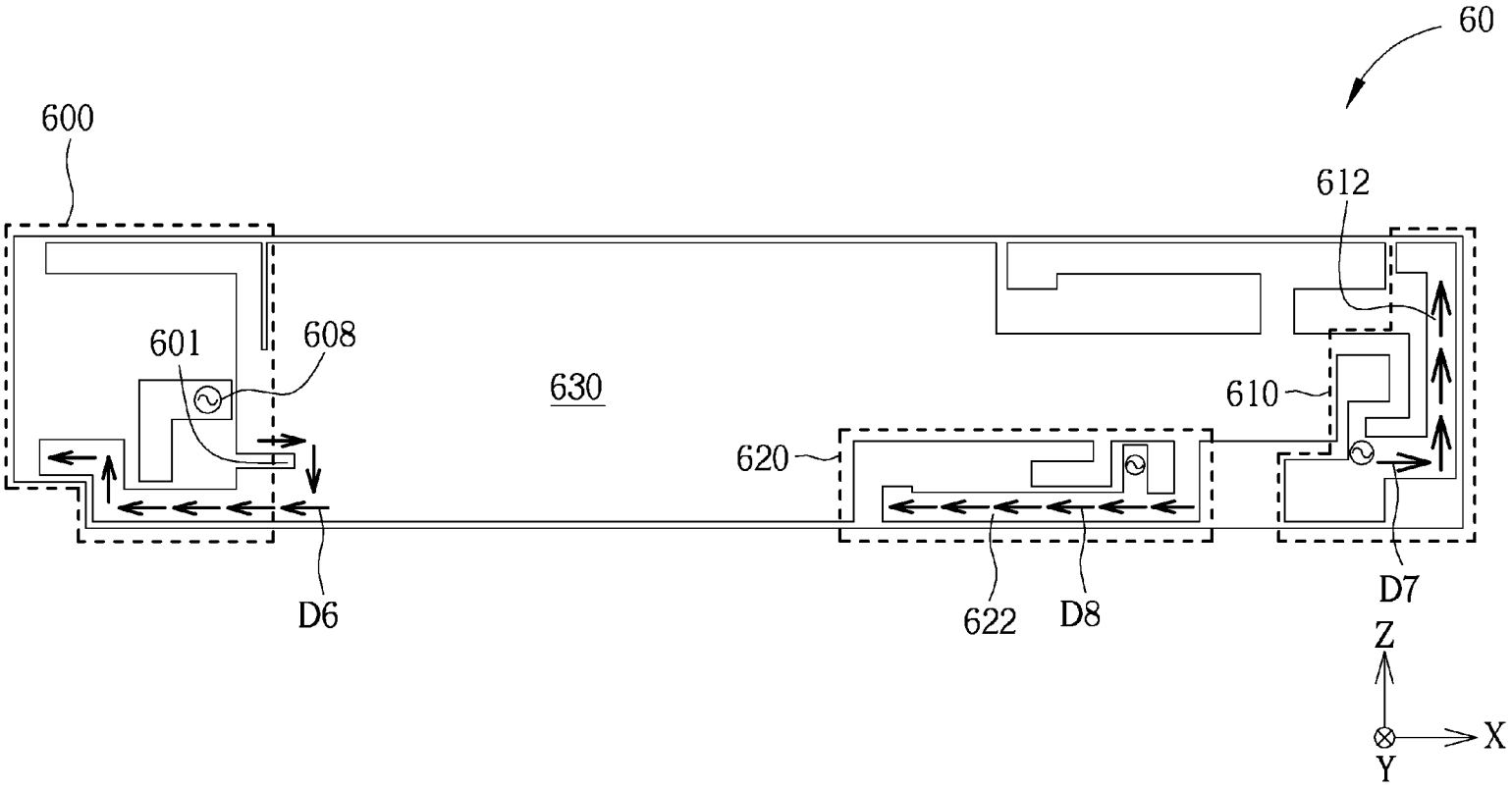
FIG. 7A shows a current distribution diagram of low-frequency signals for the radio-frequency device shown in FIG. 6.
Figure 7B:
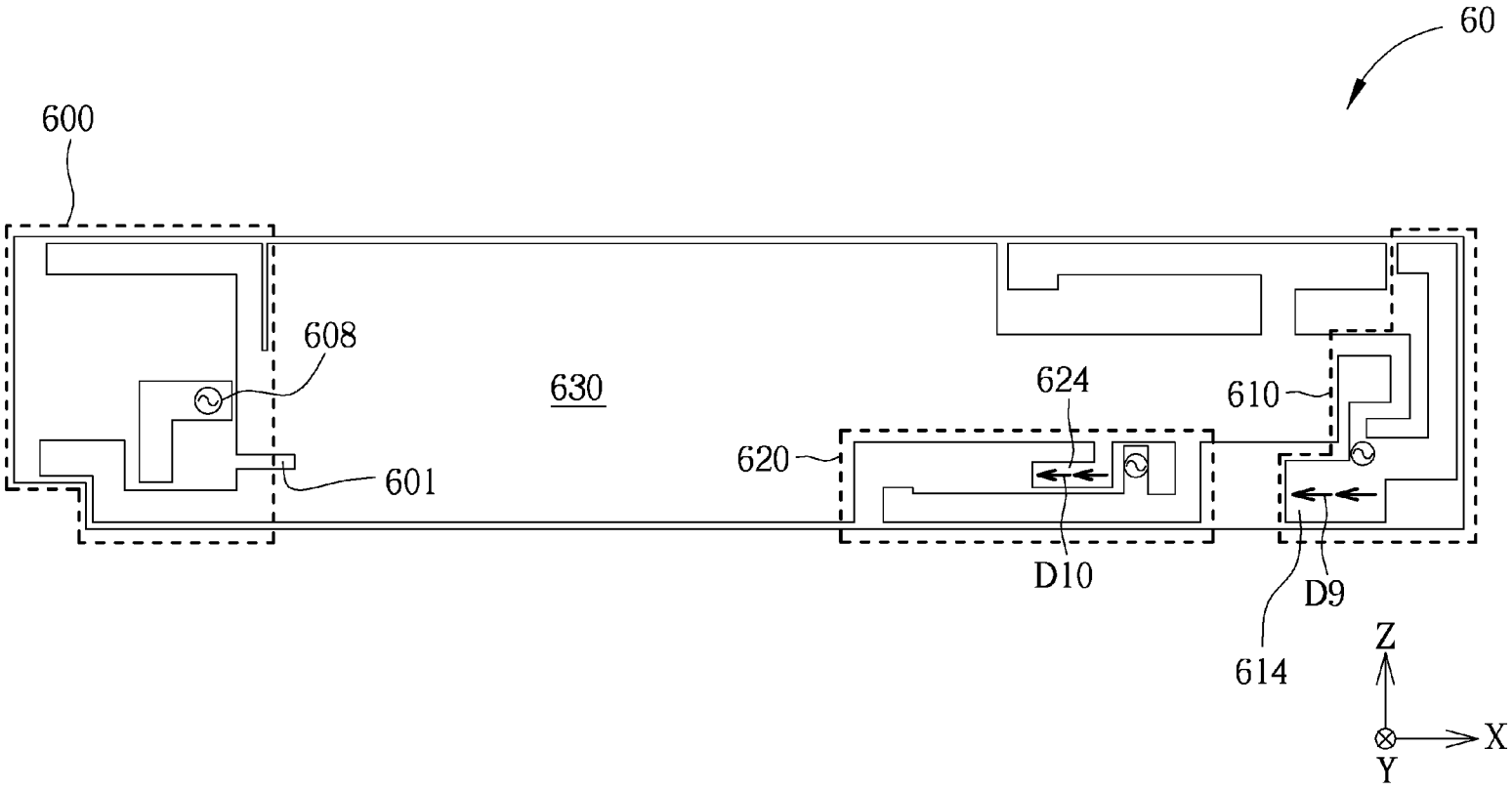
FIG. 7B shows a current distribution diagram of high-frequency signals for the radio-frequency device shown in FIG. 6.

Please refer to FIG. 7A and FIG. 7B, which respectively illustrates the current distribution diagram for low and high frequency bands when all of the first antenna 600, the second antenna 610, and the third antenna 620 are in operation at the same time. As shown in FIG. 7A, a current path D6 on the first radiating element 604 observed by the first antenna 600 flows around the slot 601 to arrive at an end of the first radiating element 604. On the other hand, the current path D6 on the first radiating element 604 observed by the second antenna 610 and the third antenna 620 flows straight to the end of the first radiating element 604 without going around the slot 601. As such, isolations between the first antenna 600, the second antenna 610 and the third antenna 620 may be enhanced because observations to the current path D6 by the first antenna 600, second antenna 610 and the third antenna 620 are different.

In addition, since the second antenna 610 and the third antenna 620 are disposed perpendicular to or orthogonal to each other, a direction of a current path D7 induced by the second radio signal on the second antenna 610 is perpendicular to a direction of a current path D8 induced by the third radio signal on the third antenna 620. Thus, good isolations between the second antenna 610 and the third antenna 620 may be achieved.

As shown in FIG. 7B, a direction of a current path D9 induced by the second radio signal on the second antenna 610 (e.g. the current on the third radiating element 614) is parallel to a direction of a current path direction D10 induced by the third radio signal on the third antenna 620 (e.g. the current on the fifth radiating element 624). Note that the second antenna 610 and the third antenna 620 operate for the same wireless communication system, wherein requirement for the isolations between the second antenna 610 and the third antenna 620 may be more flexible and achievable for practical application.

In addition, the first radiating element 604 of the first antenna 600 may be used to excite lower frequency resonant modes, while the metal coupling piece 606 may be used as a high frequency radiating element to excite higher frequency resonant modes for different applications. The short-circuit unit 616 connects the signal feed-in element 618 of the second antenna 610 with the grounding element 630 for adjusting the impedance matching. The short-circuit unit 626 connects the fourth radiating element 622 of the second antenna 610 with the grounding element 630 for adjusting the impedance matching. The short-circuit unit 616 and the short-circuit unit 626 are not constrained to any forms or shapes; they may be appropriately modified to optimize the matching and bandwidth of the second antenna 610. Further, all related alterations and modifications regarding the radio-frequency device 20 mentioned above may be applied to the radio-frequency device 60.

Figure 8:
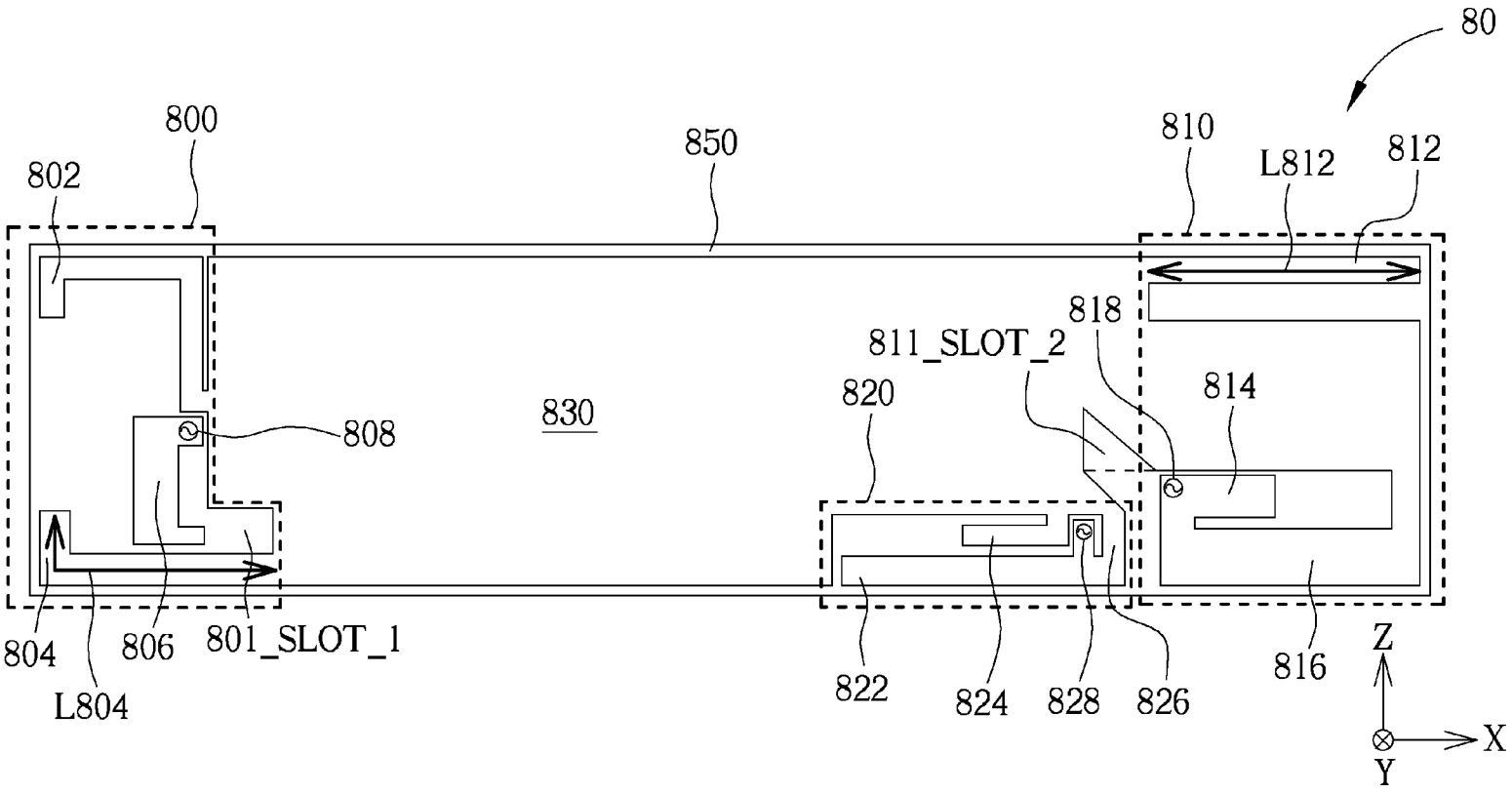
FIG. 8 is a schematic diagram of a radio-frequency device according to an embodiment of the present invention.

Please refer to FIG. 8, which is a schematic diagram of a radio-frequency device 80 according to an embodiment of the present invention. The radio-frequency devices 60 and 80 are utilized for different environmental conditions, wherein the radio-frequency devices 60 and 80 are away from metal parts of the wireless communication device by 3 and 10 mille meters along the Y-axis, respectively. A first antenna 800, a second antenna 810 and a third antenna 820 are disposed in an antenna disposition area 850. The first antenna 800 includes a first parasitic element 802, a first radiating element 804, a metal coupling piece 806 and a signal feed-in element 808. The second antenna 810 includes a second parasitic element 812 (which operates as a second radiating element), a third radiating element 814, a short-circuit unit 816, and a signal feed-in element 818. The third antenna 820 includes a fourth radiating element 822, a fifth radiating element 824, a short-circuit unit 826 and a signal feed-in element 828.

Note that the second parasitic element 812 may be used for emitting radio signals as well as guiding reflected signals generated from the first antenna 800, which prevents the fourth radiating element 822 from interfering by the reflected signals. As such, isolations between the first antenna 800 and the third antenna 820 may be enhanced. A length L804 of the first radiating element 804 and a length L812 of the second parasitic element 812 may be substantially equal to a quarter-wavelength corresponding to the frequency band of the first antenna 800. However, the lengths L804 and L812 may not be exactly the same.

The first antenna 800 and the first antenna 200 are different from a location and a size of the slot 801 SLOT 1 and a shape of the metal coupling piece 806. The first parasitic element 802 may be used for guiding reflected signals generated from the second antenna 810 and the third antenna 820 to the first parasitic element 802, which prevent the first radiating element 804 from interfering by the reflected signals. As such, the antennas may have preferable bandwidth, efficiency, and isolations. The second antenna 810 and the third antenna 820 may be disposed opposite to or symmetric to each other.

The grounding element 830 is formed with a triangle slot 811 SLOT 2. The slot 811 SLOT 2 is disposed between the second antenna 810 and the third antenna 820 to isolate currents generated by the second antenna 810 from currents generated by the third antenna 820, so as to enhance isolations between the second antenna 810 and the third antenna 820. In another embodiment of the present invention, the slot 811 SLOT 2 may be omitted.

Figure 9A:
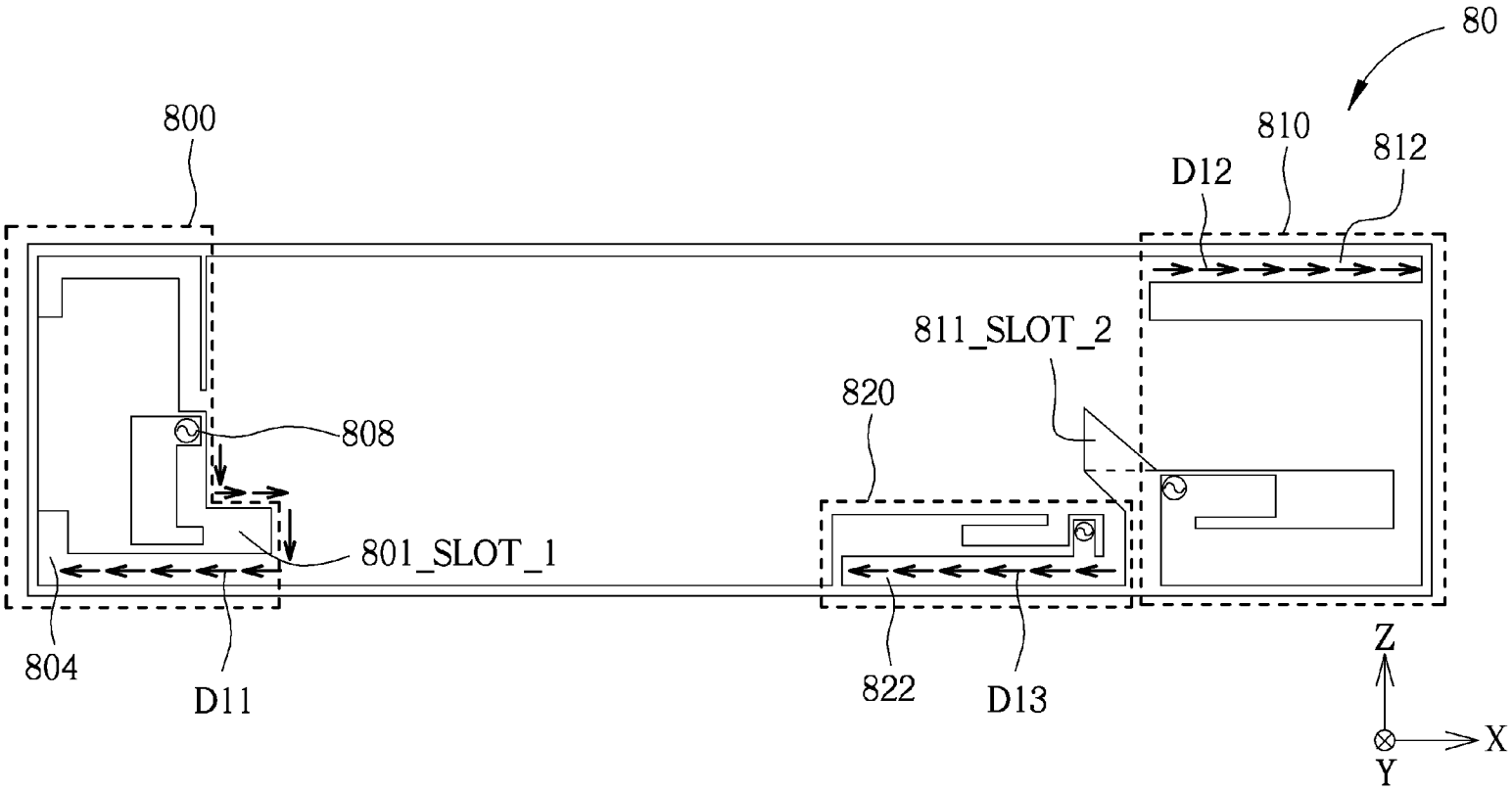
FIG. 9A shows a current distribution diagram of low-frequency signals for the radio-frequency device shown in FIG. 8.
Figure 9B:
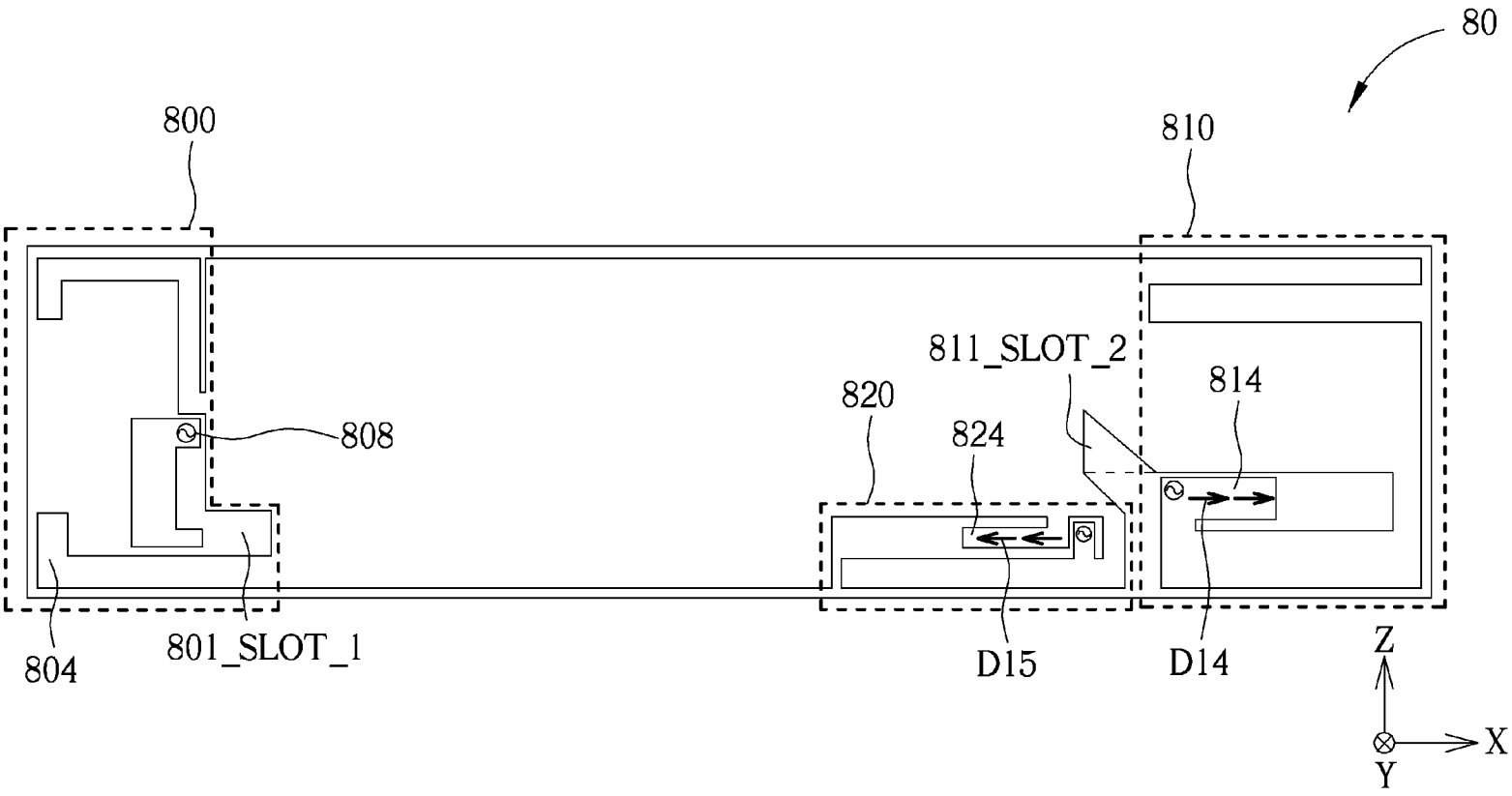
FIG. 9B shows a current distribution diagram of high-frequency signals for the radio-frequency device shown in FIG. 8.

Please refer to FIG. 9A and FIG. 9B, which respectively illustrates the current distribution diagram for low and high frequency bands when all of the first antenna 800, the second antenna 810, and the third antenna 820 are in operation at the same time. As shown in FIG. 9A, a current path D11 on the first radiating element 804 observed by the first antenna 800 flows around the slot 801 SLOT 1 to arrive at an end of the first radiating element 804. On the other hand, a current path D11 on the first radiating element 804 observed by the second antenna 810 and the third antenna 820 flows straight to the end of the first radiating element 804 without going around the slot 801 SLOT 1. As such, isolations between the first antenna 800, the second antenna 810 and the third antenna 820 may be enhanced.

In addition, the second antenna 810 and the third antenna 820 are disposed in opposite to each other (i.e. the antennas 810 and 820 may be disposed respectively toward the X-axis and the −X-axis), thereby a direction of the current path D12 induced by the second radio signal on the second antenna 810 is opposite to a direction of the current path D13 induced by the third radio signal on the third antenna 820. Thus, good isolations between the second antenna 810 and the third antenna 820 may be achieved.

As shown in FIG. 9B, a direction of a current path D14 induced by the second radio signal on the second antenna 810 (e.g. the current on the third radiating element 814) is opposite to a direction of the current path direction D15 induced by the third radio signal on the third antenna 820 (e.g. the current on the fifth radiating element 824). Thus, good isolations between the second antenna 810 and the third antenna 820 may be achieved.

Furthermore, antenna characteristics such as radiation frequency, bandwidth and efficiency are correlated with shapes and materials of radiators used in the antenna. Therefore, designers may appropriately modify, for example, the dimensions, width, and spacing of the elements/units/components in the antennas 200, 210, 220, 600, 610, 620, 800, 810 and 820 to comply with requirements of the wireless communication systems. Any alterations and modifications such as varying the material, manufacturing methods, shape, and position of the components should be within the scope of the present invention.

To sum up, the present invention utilizes the first parasitic element and the second parasitic element to guide the reflected signals of the antennas to avoid signal interference between the main radiating elements, so as to improve isolations between multiple antennas. As a result, antenna efficiencies of the multiple antennas may be effectively improved due to the improved isolations, which ensure operations for signal transmission.

Those skilled in the art will readily observe that numerous modifications and alterations of the device and method may be made while retaining the teachings of the invention. Accordingly, the above disclosure should be construed as limited only by the metes and bounds of the appended claims.

What is claimed is:

1. A radio-frequency device for a wireless communication device, comprising:

an antenna disposition area;

a grounding element, for providing ground;

a first antenna, disposed in the antenna disposition area for transmitting or receiving a first radio signal, wherein the first antenna comprises:

a metal coupling piece;

a first radiating element, electrically connected to the ground and extended directly from the grounding element for emitting the first radio signal;

a first signal feed-in element, electrically connected to the metal coupling piece for coupling the first radio signal to the first radiating element via the metal coupling piece such that the first radio signal is emitted via the first radiating element; and a first parasitic element, electrically connected to the grounding element;

a second antenna, disposed in the antenna disposition area for transmitting or receiving a second radio signal;

a third antenna, disposed in the antenna disposition area for transmitting or receiving a third radio signal; and a second parasitic element, disposed in the antenna disposition area and electrically connected to the grounding element for guiding a first reflected signal generated from the first radio signal to the second parasitic element so as to enhance isolations of the first antenna, the second antenna and the third antenna;

wherein the grounding element is disposed between the first antenna and the second parasitic element, the first antenna and the second antenna, and the first antenna and the third antenna, the grounding element is shared by the first antenna, the second antenna and the third antenna, each of the first radiating element, the first parasitic element, and the second parasitic element is formed as an extended portion of the grounding element, the metal coupling piece is disposed between the first parasitic element and the first radiating element, and the first parasitic element is used for guiding a second reflected signal generated from the second radio signal and a third reflected signal generated from the third radio signal to the first parasitic element so as to enhance isolations of the first antenna, the second antenna and the third antenna.

2. The radio-frequency device of claim 1, wherein the grounding element is formed with a first slot, the first slot is disposed between the first signal feed-in element and the first radiating element such that a current in the first radio signal flows to the first radiating element from the first signal feed-in element around the first slot.

3. The radio-frequency device of claim 1, wherein the second antenna comprises:

a second radiating element;

a third radiating element, electrically connected to the grounding element;

a second signal feed-in element, electrically connected to the second radiating element for transmitting the second radio signal to the second radiating element such that the second radio signal is emitted via the second radiating element; and a first short-circuit unit, electrically connected between the second radiating element, the grounding element and the second parasitic element.

4. The radio-frequency device of claim 1, wherein the third antenna comprises:

a fourth radiating element;

a fifth radiating element, electrically connected to the grounding element;

a third signal feed-in element, electrically connected to the fourth radiating element for transmitting the third radio signal to the fourth radiating element such that the third radio signal is emitted via the fourth radiating element; and a second short-circuit unit, electrically connected between the fourth radiating element, the grounding element and the second parasitic element.

5. The radio-frequency device of claim 1, wherein a radio signal processing unit of the wireless communication device is disposed between the first antenna, the second antenna, the third antenna and the second parasitic element in the antenna disposition area.

6. The radio-frequency device of claim 1, wherein a first length of the first parasitic element is substantially equal to a quarter-wavelength corresponding to a frequency band of the first radio signal, the second parasitic element is disposed between the first antenna and the second antenna, a second length of the second parasitic element is substantially equal to a quarter-wavelength corresponding to the frequency band of the first radio signal, and a third length of the first radiating element is substantially equal to a quarter-wavelength corresponding to the frequency band of the first radio signal.

7. The radio-frequency device of claim 1, wherein the second parasitic element comprises a branch, disposed at an end of the second radiating element for coupling the second radiating element to make signal connections between the second parasitic element and the second radiating element, wherein the second radiating element substantially extends along a first direction, the fourth radiating element substantially extends along a second direction, and the first direction is perpendicular to the second direction.

8. The radio-frequency device of claim 1, wherein the second antenna comprises:

the second parasitic element, for emitting the second radio signal;

a second radiating element, electrically connected to the grounding element;

a second signal feed-in element, electrically connected to the second radiating element for coupling the second radio signal to the second parasitic element via the second radiating element such that the second radio signal is emitted via the second parasitic element; and a first short-circuit unit, electrically connected to the second radiating element and the grounding element.

9. The radio-frequency device of claim 8, wherein the grounding element is formed with a second slot, wherein the second slot is disposed between the second antenna and the third antenna.

10. A wireless communication system, comprising:

a system grounding element, for providing ground;

a radio signal processing unit, for processing a plurality of radio signals; and a radio-frequency device, comprising:

an antenna disposition area;

a grounding element, for providing ground;

a first antenna, disposed in the antenna disposition area for transmitting or receiving a first radio signal of the plurality of radio signals, wherein the first antenna comprises:

a metal coupling piece;

a first radiating element, electrically connected to the ground and extended directly from the grounding element for emitting the first radio signal;

a first signal feed-in element, electrically connected to the metal coupling piece for transmitting the first radio signal to the first radiating element via the metal coupling piece such that the first radio signal is emitted via the first radiating element; and a first parasitic element, electrically connected to the grounding element;

a second antenna, disposed in the antenna disposition area for transmitting or receiving a second radio signal of the plurality of radio signals;

a third antenna, disposed in the antenna disposition area for transmitting or receiving a third radio signal of the plurality of radio signals; and a second parasitic element, disposed in the antenna disposition area and electrically connected to the grounding element for guiding a first reflected signal generated from the first radio signal to the second parasitic element so as to enhance isolations of the first antenna, the second antenna and the third antenna;

wherein the grounding element is disposed between the first antenna and the second parasitic element, the first antenna and the second antenna, and the first antenna and the third antenna, the grounding element is shared by the first antenna, the second antenna and the third antenna, each of the first radiating element, the first parasitic element, and the second parasitic element is formed as an extended portion of the grounding element, the metal coupling piece is disposed between the first parasitic element and the first radiating element, and the first parasitic element is used for guiding a second reflected signal generated from the second radio signal and a third reflected signal generated from the third radio signal to the first parasitic element so as to enhance isolations of the first antenna, the second antenna and the third antenna.

11. The wireless communication device of claim 10, wherein the grounding element is formed with a first slot, the first slot is disposed between the first signal feed-in element and the first radiating element such that a current in the first radio signal flows to the first radiating element from the first signal feed-in element around the first slot.

12. The wireless communication device of claim 10, wherein the second antenna comprises:

a second radiating element;

a third radiating element, electrically connected to the grounding element;

a second signal feed-in element, electrically connected to the second radiating element for transmitting the second radio signal to the second radiating element such that the second radio signal is emitted via the second radiating element; and a first short-circuit unit, electrically connected between the second radiating element, the grounding element and the second parasitic element.

13. The wireless communication device of claim 10, wherein the third antenna comprises:

a fourth radiating element;

a fifth radiating element, electrically connected to the grounding element;

a third signal feed-in element, electrically connected to the fourth radiating element for transmitting the third radio signal to the fourth radiating element such that the third radio signal is emitted via the fourth radiating element; and a second short-circuit unit, electrically connected between the fourth radiating element, the grounding element and the second parasitic element.

14. The wireless communication device of claim 10, wherein the radio signal processing unit is disposed between the first antenna, the second antenna, the third antenna and the second parasitic element in the antenna disposition area.

15. The wireless communication device of claim 10, wherein a first length of the first parasitic element is substantially equal to a quarter-wavelength corresponding to a frequency band of the first radio signal, the second parasitic element is disposed between the second antenna and the third antenna, a second length of the second parasitic element is substantially equal to a quarter-wavelength corresponding to the frequency band of the first radio signal, and a third length of the first radiating element is substantially equal to a quarter-wavelength corresponding to the frequency band of the first radio signal.

16. The wireless communication device of claim 10, wherein the second parasitic element comprises a branch, disposed at an end of the second radiating element for coupling the second radiating element to make signal connections between the second parasitic element and the second radiating element, wherein the second radiating element substantially extends along a first direction, the fourth radiating element substantially extends along a second direction, and the first direction is perpendicular to the second direction.

17. The radio-frequency device of claim 10, wherein the second antenna comprises:

the second parasitic element, for emitting the second radio signal;

a second radiating element, electrically connected to the grounding element;

a second signal feed-in element, electrically connected to the second radiating element for coupling the second radio signal to the second parasitic element via the second radiating element such that the second radio signal is emitted via the second parasitic element; and a first short-circuit unit, electrically connected to the second radiating element and the grounding element.

18. The wireless communication device of claim 17, wherein the grounding element is formed with a second slot, wherein the second slot is disposed between the second antenna and the third antenna.

* * * * *